US012350730B1

(12) United States Patent
Dunn

(10) Patent No.: US 12,350,730 B1
(45) Date of Patent: Jul. 8, 2025

(54) BENDING MANDRIL COMPRISING ULTRA HIGH MOLECULAR WEIGHT MATERIAL, RELATED BENDING MACHINES, SYSTEMS, AND METHODS

(71) Applicant: Manufacturing Resources International, Inc., Alpharetta, GA (US)

(72) Inventor: William Dunn, Alpharetta, GA (US)

(73) Assignee: Manufacturing Resources International, Inc., Alpharetta, GA (US)

( * ) Notice: Subject to any disclaimer, the term of this patent is extended or adjusted under 35 U.S.C. 154(b) by 0 days.

(21) Appl. No.: 18/397,755

(22) Filed: Dec. 27, 2023

(51) Int. Cl.
*B21D 9/04* (2006.01)
*B21D 9/05* (2006.01)

(52) U.S. Cl.
CPC ..... *B21D 9/04* (2013.01); *B21D 9/05* (2013.01)

(58) Field of Classification Search
CPC ... B21D 9/01; B21D 9/03; B21D 9/04; B21D 9/05
See application file for complete search history.

(56) References Cited

U.S. PATENT DOCUMENTS 2,907,102 A * 10/1959 Armstrong ..... B21D 9/03 29/890.149
2,986,379 A 5/1961 Kramig, Jr.
3,784,586 A 1/1974 Thomas et al.
3,823,794 A 7/1974 Bre
3,858,965 A 1/1975 Sumita
4,007,552 A 2/1977 Brooks
4,093,355 A 6/1978 Kaplit et al.
4,297,401 A 10/1981 Chern et al.
4,299,639 A 11/1981 Bayer
4,593,978 A 6/1986 Mourey et al.
4,604,444 A 8/1986 Donnadieu et al.
4,634,225 A 1/1987 Haim et al.
4,640,584 A 2/1987 Tsuboyama et al.
4,691,995 A 9/1987 Yamazaki et al.
4,712,875 A 12/1987 Tsuboyama et al.
(Continued)

FOREIGN PATENT DOCUMENTS

AU 2003242399 B2 11/2003
AU 2003285975 A1 6/2004
(Continued)

OTHER PUBLICATIONS

Dave Roos, How Transmissive Film Works, 2008, 9 Pages.
(Continued)

*Primary Examiner* — Teresa M Ekiert
(74) *Attorney, Agent, or Firm* — Standley Law Group LLP; Jeffrey S. Standley; Adam J. Smith

(57) ABSTRACT

Bending mandrils and related bending machines and methods are disclosed, which include at least one ultra-high molecular weight (UHMW) material. The mandril, which may comprise or consist of the UHMW material, is placed within an interior of a structure to be bent before the structure is bent about a pending die of the bending machine. Kerf cuts may be provided at the mandril for added flexibility. Other components of the bending machine, such as the following block and/or the bending die may also include panels of surfaces comprising a same or different UHMW material.

17 Claims, 7 Drawing Sheets

(56) References Cited

U.S. PATENT DOCUMENTS 4,715,686 A 12/1987 Iwashita et al.
4,724,023 A 2/1988 Marriott
4,766,176 A 8/1988 Lee et al.
4,896,218 A 1/1990 Vick
4,950,344 A 8/1990 Glover et al.
5,029,982 A 7/1991 Nash
5,059,484 A 10/1991 Clark et al.
5,066,699 A 11/1991 Lee et al.
5,074,092 A * 12/1991 Norlander ..... B32B 21/13 52/847
5,088,806 A 2/1992 McCartney et al.
5,148,591 A 9/1992 Pryor
5,247,374 A 9/1993 Terada
5,330,262 A 7/1994 Peters
5,365,354 A 11/1994 Jannson et al.
5,379,139 A 1/1995 Sato et al.
5,402,141 A 3/1995 Haim et al.
5,406,399 A 4/1995 Koike
5,547,483 A 8/1996 Garcia et al.
5,548,038 A 8/1996 Enami et al.
5,559,614 A 9/1996 Urbish et al.
5,601,915 A 2/1997 Ochi et al.
5,606,438 A 2/1997 Margalit et al.
5,610,742 A 3/1997 Hinata et al.
5,656,824 A 8/1997 den Boer et al.
5,661,210 A 8/1997 Burns et al.
5,748,269 A 5/1998 Harris et al.
5,767,489 A 6/1998 Ferrier
5,818,010 A 10/1998 McCann
5,823,031 A * 10/1998 Campbell ..... B21D 9/05 72/58
5,838,405 A 11/1998 Izumi et al.
5,852,484 A 12/1998 Inoue et al.
5,869,919 A 2/1999 Sato et al.
5,899,027 A 5/1999 St. Louis
5,911,899 A 6/1999 Yoshikai et al.
5,937,611 A 8/1999 Howes
5,991,153 A 11/1999 Heady et al.
6,020,945 A 2/2000 Sawai et al.
6,074,741 A 6/2000 Murata et al.
6,089,751 A 7/2000 Conover et al.
6,099,672 A 8/2000 Yamazaki et al.
6,157,432 A 12/2000 Helbing
6,191,839 B1 2/2001 Briley et al.
6,198,515 B1 3/2001 Cole
6,211,934 B1 4/2001 Habing et al.
6,219,127 B1 4/2001 Hirakata et al.
6,359,390 B1 3/2002 Nagai
6,392,727 B1 5/2002 Larson et al.
6,398,371 B1 6/2002 Matsunaga et al.
6,417,900 B1 7/2002 Shin et al.
6,421,103 B2 7/2002 Yamaguchi
6,437,673 B1 8/2002 Nishida et al.
6,446,467 B1 9/2002 Lieberman et al.
6,451,870 B1 9/2002 DeCato et al.
6,465,092 B1 10/2002 Takushima et al.
6,472,032 B1 10/2002 Asano
6,504,713 B1 1/2003 Pandolfi et al.
6,512,562 B1 1/2003 Kobayashi et al.
6,535,266 B1 3/2003 Nemeth et al.
6,555,235 B1 4/2003 Aufderheide et al.
6,611,302 B1 8/2003 Ueda et al.
6,628,355 B1 9/2003 Takahara
6,650,393 B1 11/2003 Nishiguchi
6,683,639 B2 1/2004 Driessen-Olde Scheper et al.
6,692,986 B1 2/2004 Bayer et al.
6,727,468 B1 4/2004 Nemeth
6,731,357 B1 5/2004 Tachibana et al.
6,731,367 B1 5/2004 Saitoh
6,747,720 B2 6/2004 Saiki et al.
6,762,471 B2 7/2004 Kim
6,779,252 B2 8/2004 Tracy et al.
6,818,721 B2 11/2004 Zha et al.
6,825,899 B2 11/2004 Kobayashi
6,830,348 B2 12/2004 Nakamura et al.
6,839,104 B2 1/2005 Taniguchi et al.
6,873,387 B2 3/2005 Hokazono et al.
6,885,412 B2 4/2005 Ohnishi et al.
6,909,486 B2 4/2005 Wang et al.
6,943,768 B2 9/2005 Cavanaugh et al.
6,955,833 B1 10/2005 Gallego
6,961,108 B2 11/2005 Wang et al.
7,052,152 B2 5/2006 Harbers et al.
7,059,757 B2 6/2006 Shimizu
7,083,285 B2 8/2006 Hsu et al.
7,131,313 B2 * 11/2006 Nakazato ..... B21D 9/073 72/149
7,161,642 B2 1/2007 Kim et al.
7,194,158 B2 3/2007 Schultheis et al.
7,218,812 B2 5/2007 Maxwell et al.
7,230,659 B2 6/2007 Ha et al.
7,232,250 B2 6/2007 Chuang
7,283,185 B2 10/2007 Hirakata et al.
7,295,179 B2 11/2007 Dunn
7,481,553 B2 1/2009 Kim et al.
7,481,566 B2 1/2009 Han
7,633,583 B2 12/2009 Wang et al.
7,798,694 B2 9/2010 Hwang
7,811,640 B2 10/2010 Charters et al.
7,812,919 B2 10/2010 Chien et al.
7,922,381 B2 4/2011 Han et al.
7,923,071 B2 4/2011 Charters et al.
7,924,362 B2 4/2011 Slobodin
8,004,648 B2 8/2011 Dunn
8,009,262 B2 8/2011 Dunn
8,021,900 B2 9/2011 Maxwell et al.
8,120,595 B2 2/2012 Kukulj et al.
8,208,115 B2 6/2012 Dunn
8,242,974 B2 8/2012 Yamazaki et al.
8,269,916 B2 9/2012 Ohkawa
8,274,626 B2 9/2012 Choi et al.
8,294,168 B2 10/2012 Park et al.
8,529,993 B2 9/2013 Charters et al.
8,562,770 B2 10/2013 Dunn et al.
8,674,390 B2 3/2014 Harris et al.
8,674,963 B2 3/2014 Cornish et al.
8,711,321 B2 4/2014 Dunn et al.
8,827,472 B2 9/2014 Takada
8,879,042 B2 11/2014 Dunn
9,317,060 B2 4/2016 Dunn et al.
9,573,346 B2 2/2017 Dunn et al.
9,756,739 B2 9/2017 Russell-Clarke et al.
9,950,500 B2 4/2018 Dunn et al.
10,730,269 B2 8/2020 Dunn et al.
11,591,261 B2 2/2023 Dunn et al.
11,668,695 B1 * 6/2023 Bolton ..... G01N 29/07 73/32 A
2001/0001459 A1 5/2001 Savant et al.
2001/0019454 A1 9/2001 Tadic-Galeb et al.
2001/0043293 A1 11/2001 Inoue
2002/0033919 A1 3/2002 Sanelle et al.
2002/0042162 A1 4/2002 Tone et al.
2002/0101553 A1 8/2002 Enomoto et al.
2002/0126248 A1 9/2002 Yoshida
2002/0149714 A1 10/2002 Anderson et al.
2002/0186333 A1 12/2002 Ha et al.
2002/0187575 A1 12/2002 Maruyama et al.
2003/0007109 A1 1/2003 Park
2003/0026085 A1 2/2003 Ueda et al.
2003/0090810 A1 5/2003 Detro et al.
2004/0018375 A1 1/2004 Banno et al.
2004/0032638 A1 2/2004 Tonar et al.
2004/0036834 A1 2/2004 Ohnishi et al.
2004/0062029 A1 4/2004 Ato
2004/0105159 A1 6/2004 Saccomanno et al.
2004/0113044 A1 6/2004 Ishiguchi
2004/0155997 A1 8/2004 West et al.
2004/0165139 A1 8/2004 Anderson et al.
2004/0239823 A1 12/2004 Silsby et al.
2005/0012722 A1 1/2005 Chon
2005/0062373 A1 3/2005 Kim et al.
2005/0073632 A1 4/2005 Dunn et al.
2005/0073640 A1 4/2005 Dunn et al.
2005/0105178 A1 5/2005 Kim

(56) References Cited

U.S. PATENT DOCUMENTS

| | | | |
|---|---|---|---|
| 2005/0115670 | A1 | 6/2005 | Bettinellli et al. |
| 2005/0117110 | A1 | 6/2005 | Byun et al. |
| 2005/0134526 | A1 | 6/2005 | Willem et al. |
| 2005/0212990 | A1 | 9/2005 | Robinder |
| 2005/0286131 | A1 | 12/2005 | Saxena et al. |
| 2006/0082271 | A1 | 4/2006 | Lee et al. |
| 2006/0082700 | A1 | 4/2006 | Gehlsen et al. |
| 2006/0092348 | A1 | 5/2006 | Park |
| 2006/0103299 | A1 | 5/2006 | Kwok et al. |
| 2006/0132699 | A1 | 6/2006 | Cho et al. |
| 2006/0159867 | A1 | 7/2006 | O'Donnell |
| 2006/0209266 | A1 | 9/2006 | Utsunomiya |
| 2006/0262258 | A1 | 11/2006 | Wang et al. |
| 2006/0274237 | A1 | 12/2006 | Nelson et al. |
| 2006/0279946 | A1 | 12/2006 | Park et al. |
| 2006/0289201 | A1 | 12/2006 | Kim et al. |
| 2007/0065091 | A1 | 3/2007 | Hinata et al. |
| 2007/0103854 | A1 | 5/2007 | Yu et al. |
| 2007/0139574 | A1 | 6/2007 | Ko et al. |
| 2007/0151664 | A1 | 7/2007 | Shin |
| 2007/0200095 | A1 | 8/2007 | Murazaki |
| 2007/0206158 | A1 | 9/2007 | Kinoshita et al. |
| 2007/0230218 | A1 | 10/2007 | Jachim et al. |
| 2007/0267174 | A1 | 11/2007 | Kim |
| 2007/0268201 | A1 | 11/2007 | Sampsell et al. |
| 2007/0279556 | A1 | 12/2007 | Wang et al. |
| 2008/0049164 | A1 | 2/2008 | Jeon et al. |
| 2008/0083906 | A1 | 4/2008 | Takahara et al. |
| 2008/0111949 | A1 | 5/2008 | Shibata et al. |
| 2008/0111958 | A1 | 5/2008 | Kleverman et al. |
| 2008/0146709 | A1 | 6/2008 | Aketa et al. |
| 2008/0151082 | A1 | 6/2008 | Chan |
| 2008/0176345 | A1 | 7/2008 | Yu et al. |
| 2008/0230177 | A1 | 9/2008 | Crouser et al. |
| 2008/0261057 | A1 | 10/2008 | Slobodin |
| 2008/0284942 | A1 | 11/2008 | Mahama et al. |
| 2009/0015747 | A1 | 1/2009 | Nishizawa et al. |
| 2009/0015761 | A1 | 1/2009 | Stockham |
| 2009/0021915 | A1 | 1/2009 | Kuo |
| 2009/0088547 | A1 | 4/2009 | Schamschurin et al. |
| 2009/0104989 | A1 | 4/2009 | Williams et al. |
| 2009/0153780 | A1 | 6/2009 | Takata |
| 2009/0251650 | A1 | 10/2009 | Fukagawa et al. |
| 2010/0039696 | A1 | 2/2010 | de Groot et al. |
| 2010/0043966 | A1 | 2/2010 | Dunn et al. |
| 2010/0098839 | A1 | 4/2010 | Toyoda et al. |
| 2010/0253660 | A1 | 10/2010 | Hashimoto |
| 2010/0307800 | A1 | 12/2010 | Wee et al. |
| 2011/0019363 | A1 | 1/2011 | Vahlsing et al. |
| 2011/0090630 | A1 | 4/2011 | Bergeron et al. |
| 2011/0151197 | A1 | 6/2011 | Charters et al. |
| 2011/0194053 | A1 | 8/2011 | Tannas |
| 2011/0205472 | A1 | 8/2011 | Kobayashi et al. |
| 2011/0221995 | A1 | 9/2011 | Park |
| 2012/0050958 | A1 | 3/2012 | Sanford et al. |
| 2012/0069273 | A1 | 3/2012 | Watanabe |
| 2012/0111479 | A1 | 5/2012 | Sung et al. |
| 2012/0154712 | A1 | 6/2012 | Yu et al. |
| 2012/0242926 | A1 | 9/2012 | Hsu et al. |
| 2012/0275023 | A1 | 11/2012 | Weber et al. |
| 2012/0287368 | A1 | 11/2012 | Que et al. |
| 2012/0295051 | A1 | 11/2012 | Dunn et al. |
| 2013/0027633 | A1 | 1/2013 | Park et al. |
| 2013/0051200 | A1 | 2/2013 | Oshio |
| 2013/0094160 | A1 | 4/2013 | Narumi |
| 2013/0163277 | A1 | 6/2013 | Kim et al. |
| 2013/0206063 | A1 | 8/2013 | Van Rensburg et al. |
| 2013/0329363 | A1 | 12/2013 | Dunn et al. |
| 2014/0118221 | A1 | 5/2014 | Park et al. |
| 2014/0268657 | A1 | 9/2014 | Dunn et al. |
| 2014/0285732 | A1 | 9/2014 | Tanabe et al. |
| 2014/0321103 | A1 | 10/2014 | Dunn et al. |
| 2015/0177480 | A1 | 6/2015 | Bullock et al. |
| 2015/0328671 | A1* | 11/2015 | Ilinich ..... B21D 9/03 72/466 |
| 2016/0037657 | A1 | 2/2016 | Yoshizumi |
| 2017/0210668 | A1 | 7/2017 | Dunn et al. |
| 2017/0242290 | A1 | 8/2017 | Jenkins et al. |
| 2018/0200999 | A1 | 7/2018 | Dunn et al. |
| 2018/0366685 | A1 | 12/2018 | Park et al. |
| 2020/0285099 | A1 | 9/2020 | Wang et al. |
| 2021/0046746 | A1 | 2/2021 | Xie |
| 2022/0161309 | A1* | 5/2022 | Gambino ..... B21D 9/05 |
| 2022/0260872 | A1 | 8/2022 | Dunn et al. |
| 2023/0002558 | A1 | 1/2023 | Hedge et al. |
| 2023/0159387 | A1 | 5/2023 | Dunn et al. |
| 2023/0418101 | A1 | 12/2023 | Dunn et al. |

FOREIGN PATENT DOCUMENTS

| | | | |
|---|---|---|---|
| AU | 2006214795 | A1 | 8/2007 |
| CN | 1720282 | A | 1/2006 |
| CN | 101142532 | A | 3/2008 |
| CN | 101541863 | A | 9/2009 |
| CN | 202815379 | U | 3/2013 |
| EP | 1576033 | A1 | 9/2005 |
| EP | 1640337 | A2 | 3/2006 |
| EP | 1678534 | A1 | 7/2006 |
| EP | 1851591 | A1 | 11/2007 |
| EP | 1923406 | A1 | 5/2008 |
| EP | 4291826 | A1 | 12/2023 |
| GB | 2402205 | A | 12/2004 |
| JP | 62197335 | A | 9/1987 |
| JP | 3153212 | A | 7/1991 |
| JP | 8194437 | A | 7/1996 |
| JP | H08271883 | A | 10/1996 |
| JP | 11160727 | A | 6/1999 |
| JP | 2002158475 | A | 5/2002 |
| JP | 2004205599 | A | 7/2004 |
| JP | 2005029579 | A | 2/2005 |
| JP | 2005055641 | A | 3/2005 |
| JP | 2005121940 | A | 5/2005 |
| JP | 2005134849 | A | 5/2005 |
| JP | 2005225793 | A | 8/2005 |
| JP | 2006508216 | A | 9/2006 |
| JP | 2008530317 | A | 8/2008 |
| JP | 2008292743 | A | 12/2008 |
| JP | 2010506982 | A | 3/2010 |
| JP | 2013080242 | A | 5/2013 |
| KR | 20040097466 | A | 11/2004 |
| KR | 20050084086 | A | 8/2005 |
| KR | 1020060016469 | A | 2/2006 |
| KR | 100666961 | B1 | 1/2007 |
| KR | 1020070070675 | A | 7/2007 |
| KR | 1020070103069 | A | 10/2007 |
| KR | 20080046335 | A | 5/2008 |
| KR | 20080086245 | A | 9/2008 |
| KR | 1020090064588 | A | 6/2009 |
| MY | PI20071284 | | 2/2009 |
| TW | 200702904 | A | 1/2007 |
| TW | 200809287 | A | 2/2008 |
| TW | 200838901 | A | 10/2008 |
| TW | 201114716 | A | 5/2011 |
| WO | WO2004036270 | A1 | 4/2004 |
| WO | WO2005079129 | A1 | 8/2005 |
| WO | WO2011049564 | A1 | 4/2011 |
| WO | WO2012073929 | A1 | 6/2012 |
| WO | WO2014149502 | A1 | 9/2014 |
| WO | WO2022174006 | A1 | 8/2022 |

OTHER PUBLICATIONS

Cytec, Uvekol S UV Curable Glass Laminating System, May 4, 2006, 1 Page.

Schott, Glass Made of Ideas: Opalika, 2 Pages.

Pilkington Building Products, Pilkington OptiView Anti-Reflective Glass, 2005, 2 Pages.

T.M. Zeef, T.H. Hubing, J.L. Drewniak, R.E. Dussroff & T.P. Van Doren, EMC Analysis of an 18" LCD Monitor, 08/21-25/2000, 1 Page.

3M Optical Systems, Immerse Yourself in Color, 2013, 4 Pages.

Wikipedia, Sol-gel, 2016, 12 Pages.

(56) References Cited

OTHER PUBLICATIONS

Panel-Brite, Inc., AOT (Advanced Optibond Technology), Mar. 11, 2009, 1 Page.
Dow Corning Corporation, Information About High Technology Silicone Materials, 1992, 4 Pages.
Dow Corning Corporation, Material Safety Data Sheet, Mar. 29, 2011, 8 Pages.
Pilkington Building & Speciality Glass Products, Pilkington TEC Glass For the Refrigeration Market, 2002, 2 Pages.
Mentley, David E., State of Flat-Panel Display Technology and Future Trends, Proceedings of the IEEE, Apr. 2002, vol. 90, No. 4, pp. 453-459.

* cited by examiner

BENDING MANDRIL COMPRISING ULTRA HIGH MOLECULAR WEIGHT MATERIAL, RELATED BENDING MACHINES, SYSTEMS, AND METHODS

CROSS-REFERENCE TO RELATED APPLICATIONS

This application is filed as original and therefore makes no priority claim.

TECHNICAL FIELD

Exemplary embodiments relate generally to bending mandrils comprising ultra-high molecular weight (UHMW) material(s) as well as related bending machines, systems, and methods.

BACKGROUND AND SUMMARY OF THE INVENTION

Bending machines are known. These machines are used to bend relatively strong material, such as one or more metals, metal alloys, or the like. Where it is desired to bend a hollow structure, such as a tube, it is known to employ mandrils. Typically, a mandril is inserted within the hollow structure to preserve its shape (e.g., prevent it from collapsing) while the structure is bent. Conventionally, these mandrils consist of metal structures which are linked together in a fashion which provides a level of flexibility. However, metal can scratch the structure and/or be overly rigid, resulting in damage to the structure, such as cracking. This is particularly true of relatively large, relatively thin walled, and/or relatively cuboidal structures (i.e., those having a substantially square or rectangular cross section). Alternatively, or additionally, this is particularly true of certain materials such as aluminum or certain aluminum alloys. What is needed is an improved mandril for bending structures.

A bending mandril comprising UHMW material is provided along with related bending machines, systems, and methods. The bending mandril may comprise or consist of one or more UHMW materials. Preferably, the UHMW material is a polymer, such as but not limited to UHMW polyethylene.

In exemplary embodiments, without limitation, the bending mandril is formed into an elongate, generally cuboidal shape to match or substantially match (e.g., fill at least 80% of) the interior shape of an interior space of a structure to be bent. Preferably, kerf cuts are provided in at least one surface of the mandril to increase flexibility for bending with the structure during the bending process. In other exemplary embodiments, without limitation, the mandril may comprise multiple segments, each comprising, substantially comprising (e.g., making up at least 80% of the material by wight), or consisting of, UHMW material, which are joined together flexibly, such as by way of a cable or other flexible line, hinged linkage, combinations thereof, or the like.

The bending mandril may be located at a distal portion of a mandril rod of a bending machine. The bending mandril may be inserted into a structure to be bent prior to bending. After bending, the bending mandril may be removed from the structure. In exemplary embodiments, without limitation, the same or a different UHMW materials may be provided at panels of the bending machine that contact the structure for bending, such as to reduce or eliminate scratching, marring, or other types of damage.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical, similar, or equivalent features, and wherein.

DETAILED DESCRIPTION OF EXEMPLARY EMBODIMENT(S)

Figure 1:
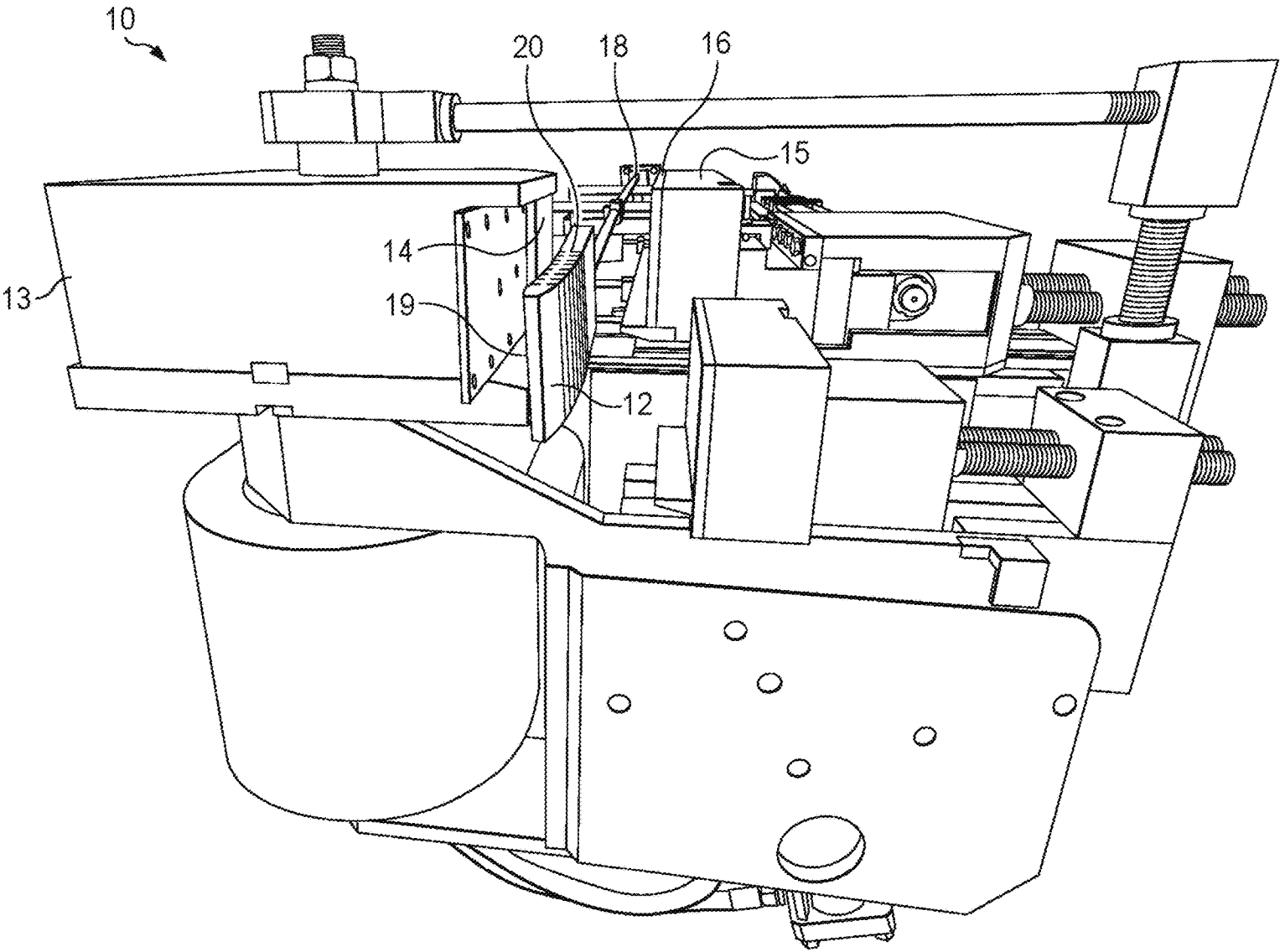
FIG. 1 is a rear, detailed perspective view of an exemplary bending machine with exemplary UHMW mandril.
Figure 2:
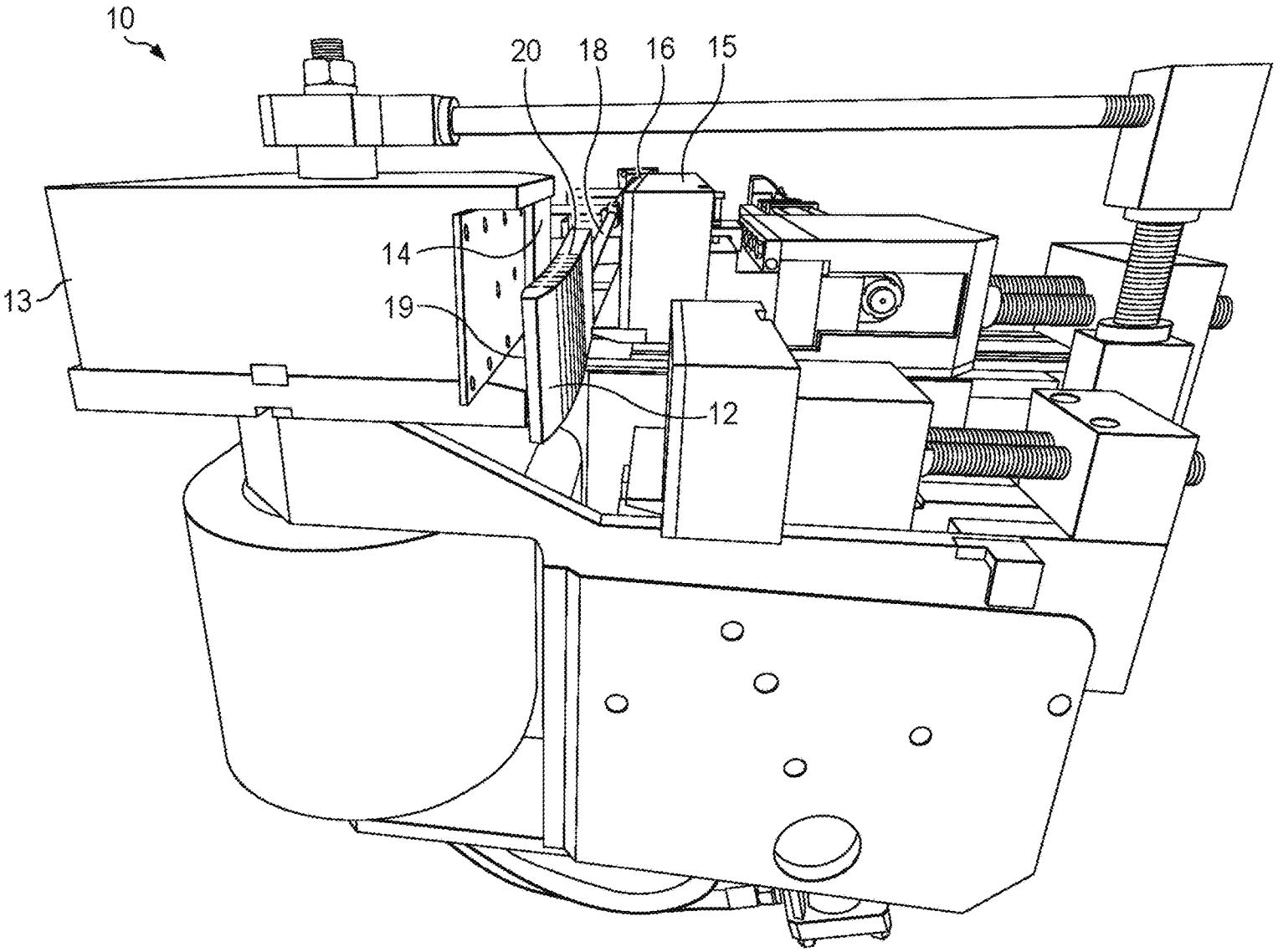
FIG. 2 is another rear perspective view of the bending machine of FIG. 1.
Figure 3:
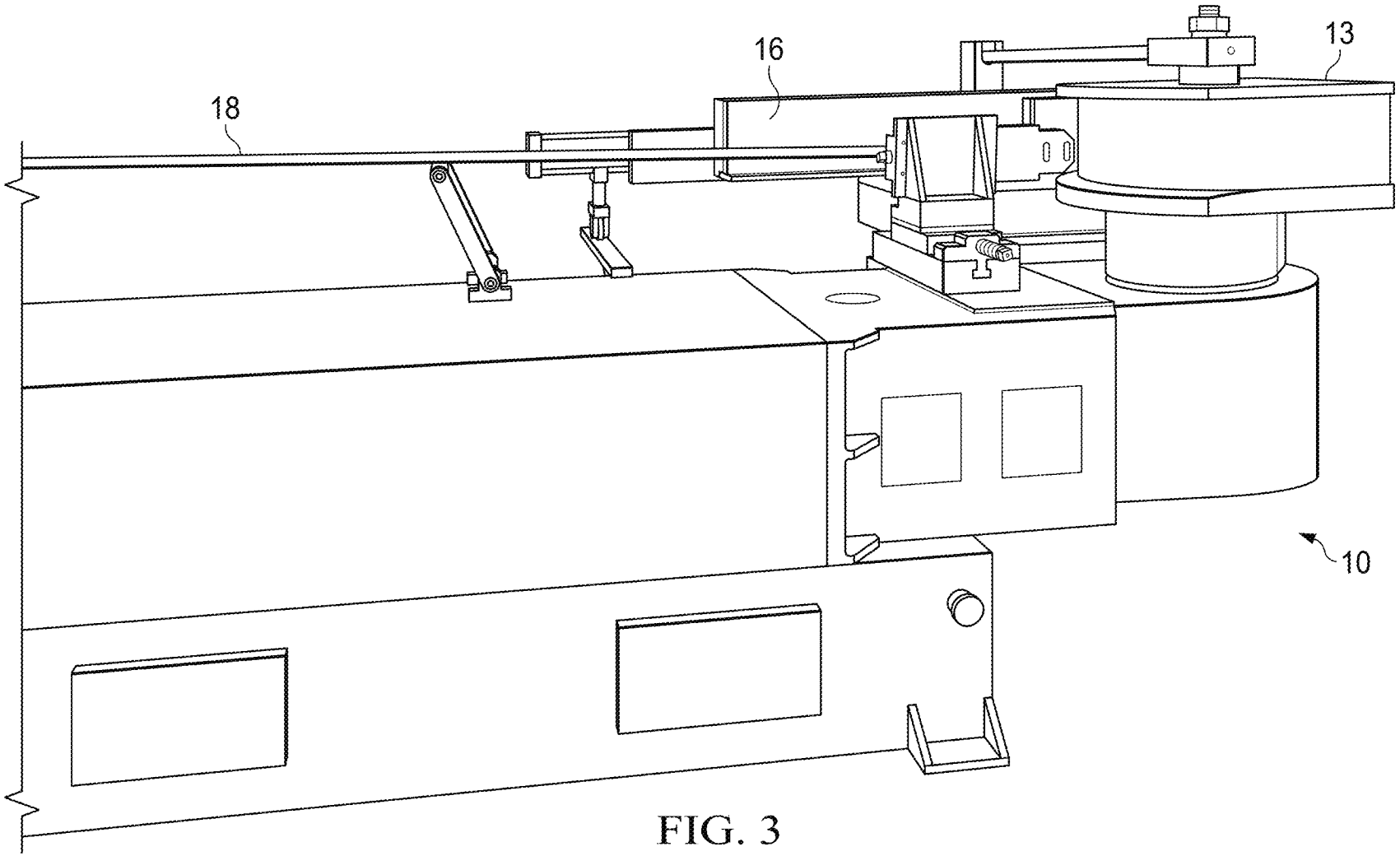
FIG. 3 is a side view of the bending machine of FIG. 1.
Figure 4:
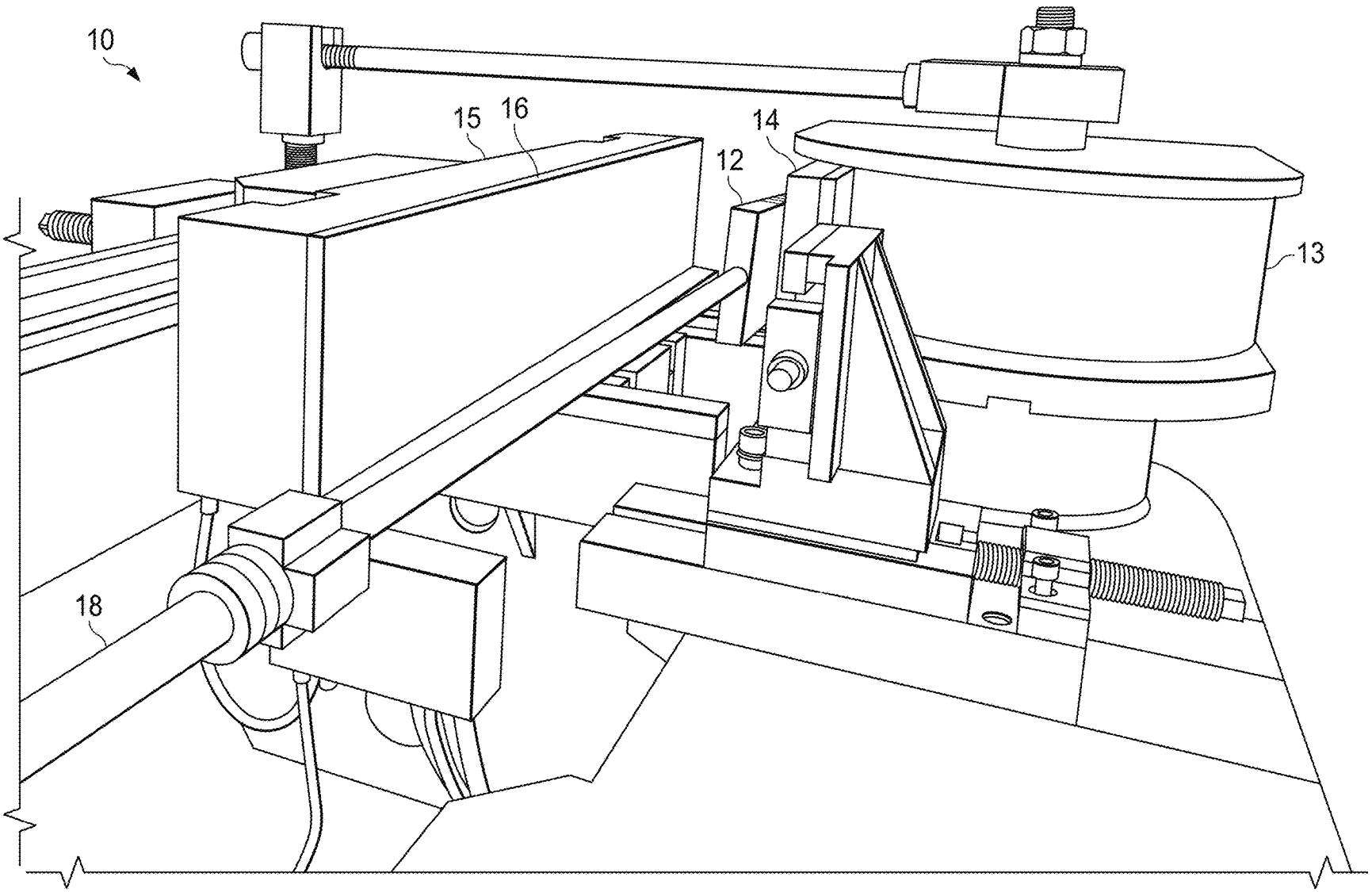
FIG. 4 is a front, detailed perspective view of the bending machine and UHMW mandril of FIG. 1.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

FIG. 1 through FIG. 4 illustrate an exemplary bending machine 10 with an exemplary UHMW mandril 12. The bending machine 10 in exemplary embodiments, without limitation, may include the HINES® bending systems, such as but not limited to the 600NC Model, available from Hines Bending Systems Inc. of Fort Meyers, FL (https://hinesbending.com). However, as those of skill in the art will recognize, these disclosures, including but not limited to the UHMW mandrils 12, may be used with a wide variety of types and kinds of bending machines 10 from a wide variety of providers of such bending machines 10. These disclosures are not intended to be limited to use with any particular make or model of bending machine 10.

The bending machine 10 may comprise conventional bending machine components, such as but not necessarily limited to, one or more fixed objects (e.g., follower block 15, clamp blocks, wiper dies, combinations thereof, or the like), mandril rods 18, bending dies 13, control panels, and the like.

The bending mandril 12 may comprise, substantially comprise (e.g., make up at least 80% of the material by weight), or consist of one or more UHMW materials. Preferably, the UHMW material is a polymer, such as but not limited to UHMW polyethylene. A wide variety of types and kinds of UHMW material may be utilized.

In exemplary embodiments, without limitation, the bending mandril 12 is formed into an elongate shape, such as a generally cuboidal shape. The bending mandril 12 may be sized and/or shaped to match, or to substantially match (e.g., fill at least 80% of), an interior shape of a structure to be bent. The use of UHMW material may provide sufficient flexibility for bending with the structure. In other exemplary embodiments, without limitation, kerf cuts 20 are provided in at least one surface of the mandril 12, such as a surface facing the follower block 15, to provide the bending mandril 12 with greater flexibility. Kerf cuts 20 may be provided on multiple surfaces, such as the surface facing the follower block 15 and a surface facing the bending die 13 by way of non-limiting example.

The bending mandril 12 may be located at a distal portion of a mandril rod 18 of a bending machine 10. The bending mandril 12 may be inserted into a structure to be bent prior to bending. After bending, the bending mandril 12 may be removed from the structure.

Certain additional components of the bending machine 10, such as but not necessarily limited to those which contact the structure for bending, may be provided with, comprise, substantially comprise (e.g., make up at least 80% by weight of), or consist of a same or different UHMW material. This may reduce or eliminate scratching, marring, or other types of damage to the structure during bending and/or otherwise improve performance of the mandril 12. In exemplary embodiments, without limitation, such panels may comprise a first panel 14 provided at the bending die 13 and a second panel 16 provided at the follower block 15. The first and second panels 14, 16 may be provided at existing surfaces such that the panels are separable components which are attached to the bending machine (e.g., by one or more fasteners) and/or permanently affixed (e.g., adhesive) components, or may be integrally formed with the machine 10.

A forward portion 19 of the bending mandril 12 may optionally comprise one or more tapered edges, such as but not limited to formed into a point and/or generally pyramidal shape. This may assist with insertion of the mandril 12 into the structure.

Figure 5:
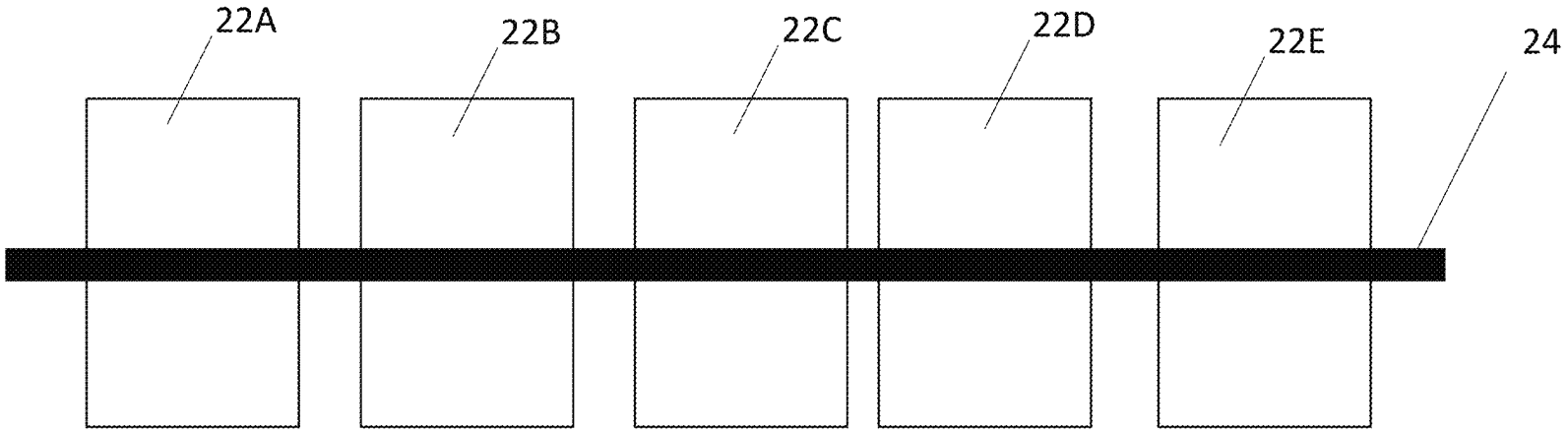
FIG. 5 is a side view of another exemplary UHMW mandril.
Figure 6:
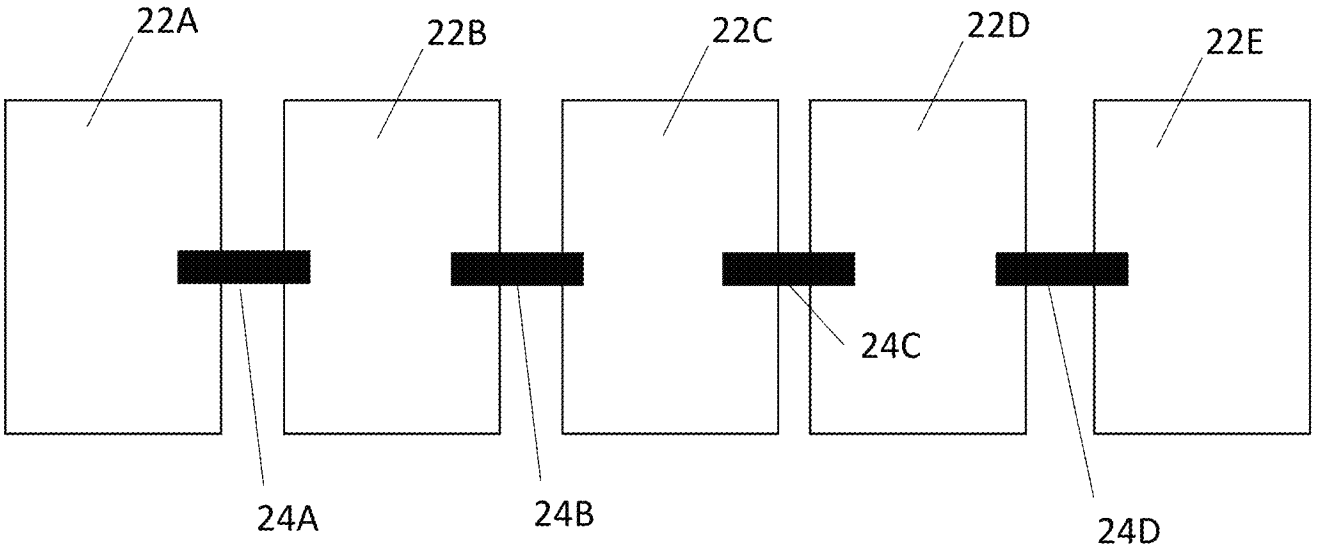
FIG. 6 is a side view of another exemplary UHMW mandril.

In other exemplary embodiments, such as illustrated in FIG. 5 and FIG. 6 by way of non-limiting example, the mandril 12 may comprise multiple segments 22A, 22B, 22C, 22D, 22E, etc. Varying number, size, and shape segments 22 may be utilized. Each of the segments 22 may comprise, substantially comprise (e.g., make up at least 80% by weight of), or consist of UHMW material. The segments 22 may be joined together one or more linkages 24 to provide such flexibility during bending. The linkage 24 may comprise one or more cables or other flexible line, hinged structures or other hinging members or components, combinations thereof, or the like. In such embodiments, the linkage(s) 24 may comprise or consist of UHMW materials or another material, such a plastic, metal, combinations thereof, or the like. The linkage(s) 24 may extend through each or multiple of the segments 22 (e.g., FIG. 5), along one or more exterior surfaces thereof, between each of the segments 22 (e.g., FIG. 6), combinations thereof, or the like.

Figure 7:
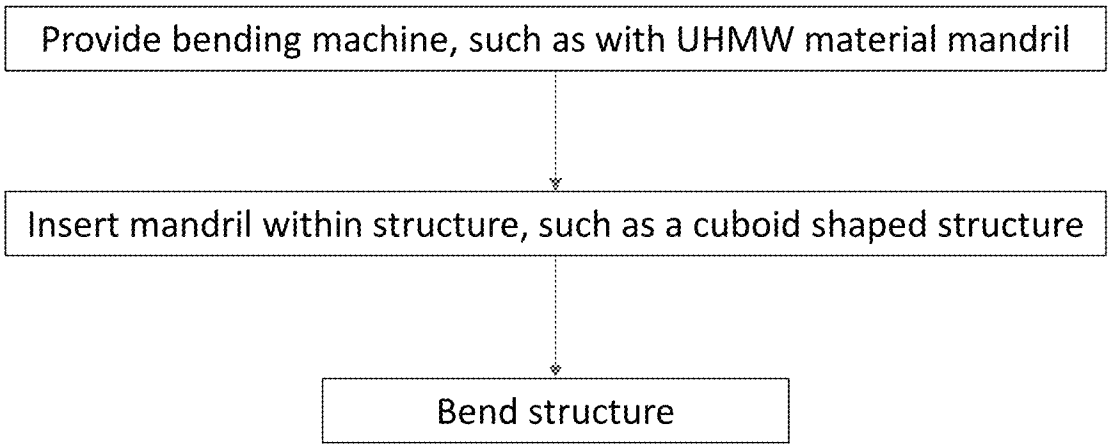
FIG. 7 is a flow chat providing an exemplary method of using the bending machine of FIG. 1.

With particular regard to FIG. 7, the mandril 12 may be inserted into a structure to be bent using the machine 10. In exemplary embodiments, without limitation, the structure is one where, at least the portion to be bent, has a generally cuboid shape and/or square or rectangular cross section. Alternatively, or additionally, the structure may comprise, substantially comprise (e.g., at least 80%), or consist of aluminum or certain aluminum alloys. The UHMW mandril 12 may be particularly well suited to reducing damages to such structures, such as from engagement with the structures, bending, combinations thereof, or the like. The structure may be positioned at the machine 10, such as between the first and second panels 14, 16, when utilized, but regardless between the bending die 13 and the follower block 15. The machine 10 may be activated for bending the structure about the bending die 13. The mandril 12 may be removed from the bent structure.

The bending machine 10, including but not limited to movement of the mandril 12, may be electronically controlled and/or motorized, though such is not necessarily required.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention.

Certain operations described herein may be performed by one or more electronic devices. Each electronic device may comprise one or more processors, electronic storage devices, executable software instructions, combinations thereof, and the like configured to perform the operations described herein. The electronic devices may be general purpose computers or specialized computing devices. The electronic devices may comprise personal computers, smartphones, tablets, databases, servers, or the like. The electronic connections and transmissions described herein may be accomplished by one or more wired or wireless connectively components (e.g., routers, modems, ethernet cables, fiber optic cable, telephone cables, signal repeaters, and the like) and/or networks (e.g., internets, intranets, cellular networks, the world wide web, local area networks, and the like). The computerized hardware, software, components, systems, steps, methods, and/or processes described herein may serve to improve the speed of the computerized hardware, software, systems, steps, methods, and/or processes described herein. The electronic devices, including but not necessarily limited to the electronic storage devices, databases, controllers, or the like, may comprise and/or be configured to hold, solely non-transitory signals.

What is claimed is:

1. A bending mandril comprising:

a body comprising an ultra-high molecular weight (UHMW) material configured to fit within an interior of a hollow structure comprising metal during bending of said hollow structure; and kerf cuts spaced apart along a longitudinally extending surface of the mandril, wherein said kerf cuts extend lateral relative to a longitudinal axis of the surface, and wherein each of said kerf cuts extend part way, depth-wise, from the surface into an underlying portion of the bending mandril;

wherein the body has a cuboid shape configured to snugly fit within a cuboid shaped interior hollow structure.

2. The bending mandril of claim 1 wherein the body consists of the UHMW material.

3. The bending mandril of claim 1 wherein the body comprises multiple sections joined by one or more linkages.

4. The bending mandril of claim 3 wherein the one or more linkages comprises a single flexible line extending through each of the multiple sections.

5. The bending mandril of claim 3 wherein the one or more linkages comprises a hinge located between each of the multiple sections.

6. The bending mandril of claim 1 wherein a forward portion of the body comprises one or more tapered edges.

7. The bending mandril of claim 6 wherein the forward portion of the body comprises a pyramidal shape.

8. A bending machine comprising:

a bending die;

a follower block;

a mandril rod; and a mandril located at a distal end of the mandril rod and comprising kerf cuts located along a longitudinally extending surface thereof, wherein each of said kerf cuts extend lateral relative to a longitudinal axis of the surface and are spaced apart from one another along the surface, and wherein each of said kerf cuts extend part way, depth-wise, through an underlying portion of the mandril;

wherein the mandril and at least one of the bending die and the follower block each comprise an ultra-high molecular weight (UHMW) material.

9. The bending machine of claim 8 wherein:

the mandril and the at least one of the bending die and the follower block consists of the UHMW material.

10. The bending machine of claim 8 wherein:

the bending die comprises a first panel attached to an exterior surface thereof at least substantially comprising the UHMW material; and the follower block comprises a second panel attached to an exterior surface thereof at least substantially comprising the UHMW material.

11. The bending machine of claim 10 wherein:

the mandril at least substantially comprises the UHMW material.

12. The bending machine of claim 8 wherein:

the bending mandril comprises multiple sections joined by one or more linkages.

13. The bending machine of claim 8 wherein:

each of the bending die, the follower block, and the mandril comprise the UHMW material.

14. The bending mandril of claim 8 wherein:

the bending mandril comprises a single block comprising the UHMW material.

15. A method for bending a hollow structure comprising:

providing a bending machine comprising:

a bending die;

a follower block;

a mandril rod; and a mandril located at a distal end of the mandril rod, wherein the mandril comprises a body having a cuboid shape, a tapered end, and kerf cuts spaced apart along a longitudinally extending surface of the body, wherein each of said kerf cuts extend lateral relative to a longitudinal axis of the surface, extend an entirety of a lateral dimension of the surface, and extend not more than part way, depth-wise, through an underlying portion of the body;

wherein the mandril, the bending die, and the follower block, comprise an ultra-high molecular weight (UHMW) material;

placing the mandril within an interior of the structure, wherein the interior of the structure comprises a square or rectangular cross section, and wherein the structure at least substantially comprises aluminum or an aluminum alloy; and bending the structure about the bending die.

16. A bending mandril comprising:

a body comprising an ultra-high molecular weight (UHMW) material configured to fit within an interior of a hollow structure comprising metal during bending of said hollow structure; and kerf cuts spaced apart along a longitudinally extending surface of the mandril, wherein said kerf cuts extend lateral relative to a longitudinal axis of the surface, and wherein each of said kerf cuts extend part way, depth-wise, from the surface into an underlying portion of the bending mandril;

wherein a forward portion of the body comprises one or more tapered edges.

17. The bending mandril of claim 16 wherein the forward portion of the body comprises a pyramidal shape.

* * * * *